US007578652B2

(12) United States Patent
Norris et al.

(10) Patent No.: US 7,578,652 B2
(45) Date of Patent: Aug. 25, 2009

(54) HYBRID VAPOR AND FILM COOLED TURBINE BLADE

(75) Inventors: James W. Norris, Lebanon, CT (US); James D. Hill, Tolland, CT (US)

(73) Assignee: United Technologies Corporation, Hartford, CT (US)

( * ) Notice: Subject to any disclaimer, the term of this patent is extended or adjusted under 35 U.S.C. 154(b) by 480 days.

(21) Appl. No.: 11/542,097

(22) Filed: Oct. 3, 2006

(65) Prior Publication Data

US 2008/0080980 A1 Apr. 3, 2008

(51) Int. Cl.
*F01D 5/14* (2006.01)

(52) U.S. Cl. ..... 415/115; 416/97 R

(58) Field of Classification Search ..... 416/95, 416/96 A, 96 R, 97 R; 415/114, 115
See application file for complete search history.

(56) References Cited

U.S. PATENT DOCUMENTS 2,755,062 A 7/1956 Hill
3,334,685 A 8/1967 Burggraf et al.
5,151,012 A * 9/1992 Hough ..... 416/95
5,201,634 A * 4/1993 Hough ..... 416/96 R
5,634,766 A * 6/1997 Cunha et al. ..... 415/115
5,857,836 A 1/1999 Stickler et al.
5,954,478 A 9/1999 Stickler et al.
6,142,730 A * 11/2000 Tomita et al. ..... 415/115
6,931,834 B2 8/2005 Jones
6,974,306 B2 12/2005 Djeridane et al.
6,981,845 B2 1/2006 Balland et al.
6,988,367 B2 1/2006 Thompson, Jr. et al.
2006/0120855 A1 6/2006 Djeridane et al.
2007/0022732 A1 2/2007 Holloway et al.

FOREIGN PATENT DOCUMENTS

GB 2254380 A * 10/1992
WO WO 2005/073539 A1 8/2005

* cited by examiner

*Primary Examiner*—Edward Look
*Assistant Examiner*—Ryan H Ellis
(74) *Attorney, Agent, or Firm*—Kinney & Lange, P.A.

(57) ABSTRACT

An apparatus for a gas turbine engine includes an airfoil defining a leading edge and a trailing edge, a root located adjacent to the airfoil, a vapor cooling system, and a film cooling system for cooling the airfoil in conjunction with the vapor cooling system. The vapor cooling system includes a vaporization section located within the airfoil and a condenser section located within the root.

6 Claims, 4 Drawing Sheets

HYBRID VAPOR AND FILM COOLED TURBINE BLADE

BACKGROUND OF THE INVENTION

The present invention relates to cooling systems for fluid reaction devices for gas turbine engines.

In order to operate a gas turbine engine at optimal conditions, temperatures in the hot region of the primary gas flowpath are often very high. High temperatures can have negative effects on engine components exposed to the primary flowpath, increasing risks for component degradation and failure. Indeed, temperatures at some points along the primary flowpath can exceed the melting points of materials used to form some engine components. For that reason, cooling systems are used to reduce damage and wear on engine components associated with high temperature conditions. Vapor cooling systems (synonymously called evaporative cooling systems) have been proposed as a way to cool fluid reaction devices in gas turbine engines, such as turbine blades and vanes. In general, these vapor cooling systems include sealed internal cavities and passageways that form a vaporization section and a condenser section. A liquid is distributed to the vaporization section, which is located in a portion of the blade or vane that is exposed to high temperatures (typically the airfoil portion). The liquid absorbs thermal energy and is converted to a gas as the liquid surpasses its boiling point. The gas moves through the sealed cavities and passageways to the condenser section, where thermal energy is removed and the gas is converted back to a liquid. Thermal energy is typically removed from the condenser section of the vapor cooling system by passing engine bleed air along exterior surfaces of the condenser section. The liquid from the condenser section is then returned to the vaporization section, and the process can begin again.

Known designs present a number of problems that hinder and may prevent the effective implementation of a vapor cooling scheme in gas turbine engines. One such problem is that vapor cooling systems are ineffective in cooling the trailing edges of the airfoils of turbine blades or vanes. Vaporization chambers for a hot airfoil section of a turbine blade or vane require internal passageways that take up significant space. However, the trailing edges of airfoils are thin sections that do not provide adequate space for internal vaporization section structures and passageways. Normally, this would mean that only a leading edge portion of the airfoil would be vapor cooled, while the trailing edge would remain uncooled. However, inadequate trailing edge cooling is undesirable and may prevent the practical application of vapor cooling in gas turbine engines. Conversely, increasing the cooling of the leading edge portion to indirectly cool the trailing edge can result in over-cooling of the leading edge of the blade or vane, which can reduce engine performance undesirably.

Furthermore, vapor cooling systems typically cool the condenser, which is typically located within a root portion of the cooled blade or vane, by passing engine bleed air around it. However, known vapor cooling systems do not provide for an efficient exhaust path for the "spent" bleed air that has absorbed thermal energy from the condenser. Spent bleed air allowed to seep into the primary airflow at an angle can cause undesired mixing loss, which reduces engine power efficiency and fuel efficiency.

It is desired to provide a cooling system for a turbine blade or vane that utilizes vapor cooling of the airfoil while also providing adequate cooling to the airfoil trailing edge. It is further desired to provide an efficient exhaust route for spent air used to cool a condenser of a vapor cooling system for a turbine blade or vane.

BRIEF SUMMARY OF THE INVENTION

An apparatus for a gas turbine engine according to the present invention includes an airfoil defining a leading edge and a trailing edge, a root located adjacent to the airfoil, a vapor cooling system, and a film cooling system for cooling the airfoil in conjunction with the vapor cooling system. The vapor cooling system includes a vaporization section located within the airfoil and a condenser section located within the root.

DETAILED DESCRIPTION

In general, the present invention provides a hybrid cooling system that can provide vapor cooling (synonymously called evaporative cooling) to a leading edge portion of an airfoil of a turbine blade or vane along with film cooling to a trailing edge portion of the airfoil. Furthermore, air used to cool a condenser of a vapor cooling subsystem can be directed to a film cooling subsystem, which exhausts the air into a primary engine flowpath in an efficient manner.

Figure 1:
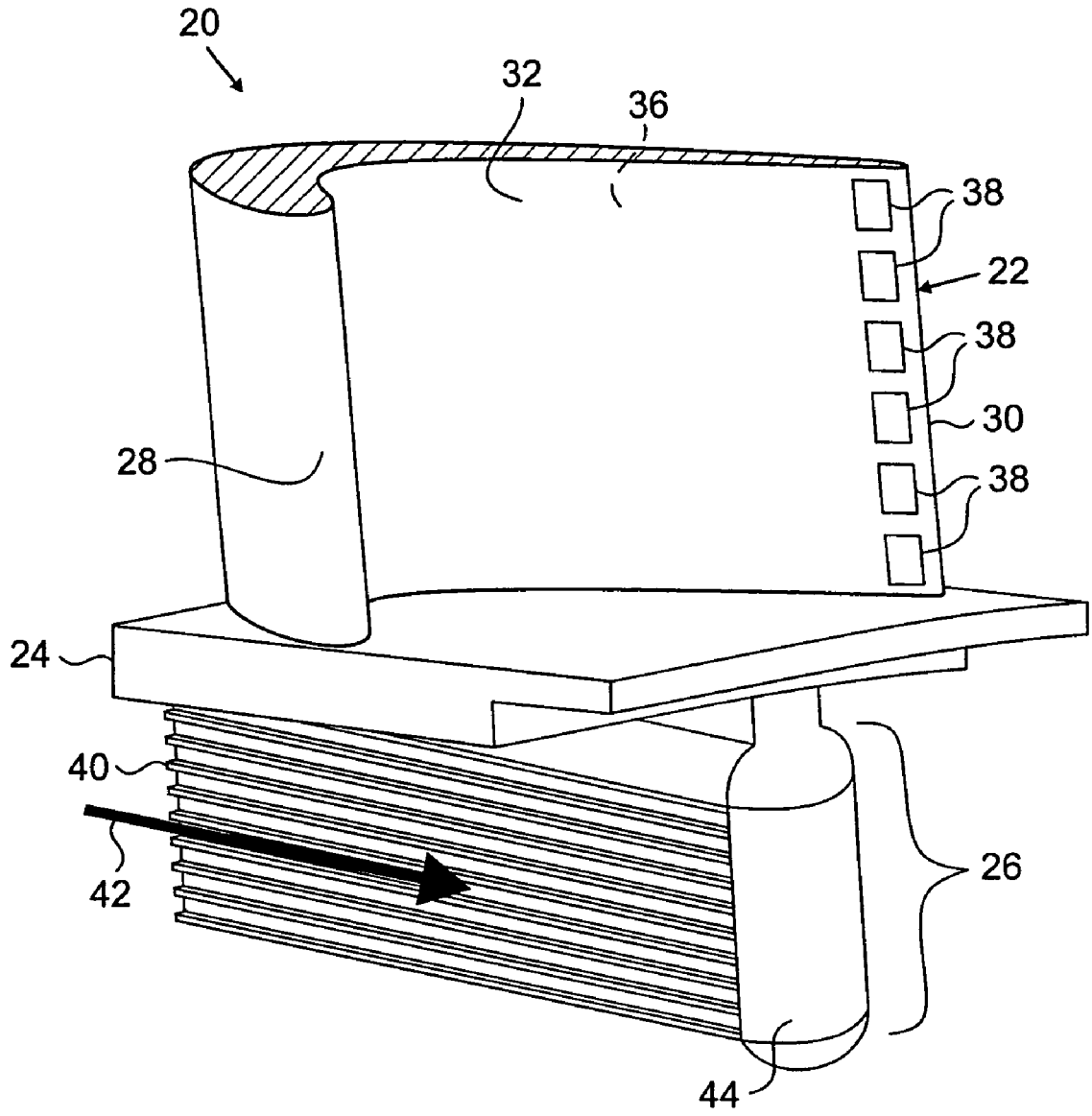
FIG. 1 is a perspective view of a portion of a turbine blade according to the present invention.

FIG. 1 is a perspective view of a portion of a turbine blade 20 for a gas turbine engine. The blade 20 includes an airfoil 22 (in the interest of simplicity, only a portion of the airfoil 22 is shown in FIG. 1, and the internal structures of the airfoil 22 are not shown in cross section), a platform 24, and a root portion 26.

The airfoil 22 is an aerodynamically shaped fluid reaction member that extends outward from the platform 24 and is positionable within a flowpath of the engine to perform work with respect to fluid moving along the flowpath. The airfoil 22 defines a leading edge 28, a trailing edge 30, a pressure side 32 and a suction side 34 (not visible in FIG. 1). As will be explained further below, a vaporization chamber 36 is located inside the airfoil 22 at its leading edge 28. A number of film cooling openings 38 are located at the trailing edge 30 of the airfoil 22. The openings 38 are slots similar to known film cooling slots for gas turbine airfoils. The total number of openings 38 will vary depending upon the desired amount of film cooling.

The particular configuration of the airfoil 22 as shown in FIG. 1 is merely exemplary. It should be understood that the particular configuration of the airfoil 22 and other structures of the blade 20 will vary according to the desired application.

The root portion 26 forms a dovetail shape (e.g., a single lug shape, fir tree shape, etc.) for retaining the blade 20 in a corresponding slot (not shown) in a conventional manner. In the illustrated embodiment, the root portion 26 of the blade 20 is configured to be retained in an axially oriented slot formed in an outer rim of a rotor disk (not shown). The root portion 26 also contains a condenser 40 that is linked to the vaporization chamber 36. Airflow 42 can be directed along the exterior of the condenser 40 to remove thermal energy, as will be explained in greater detail below.

Figure 2:
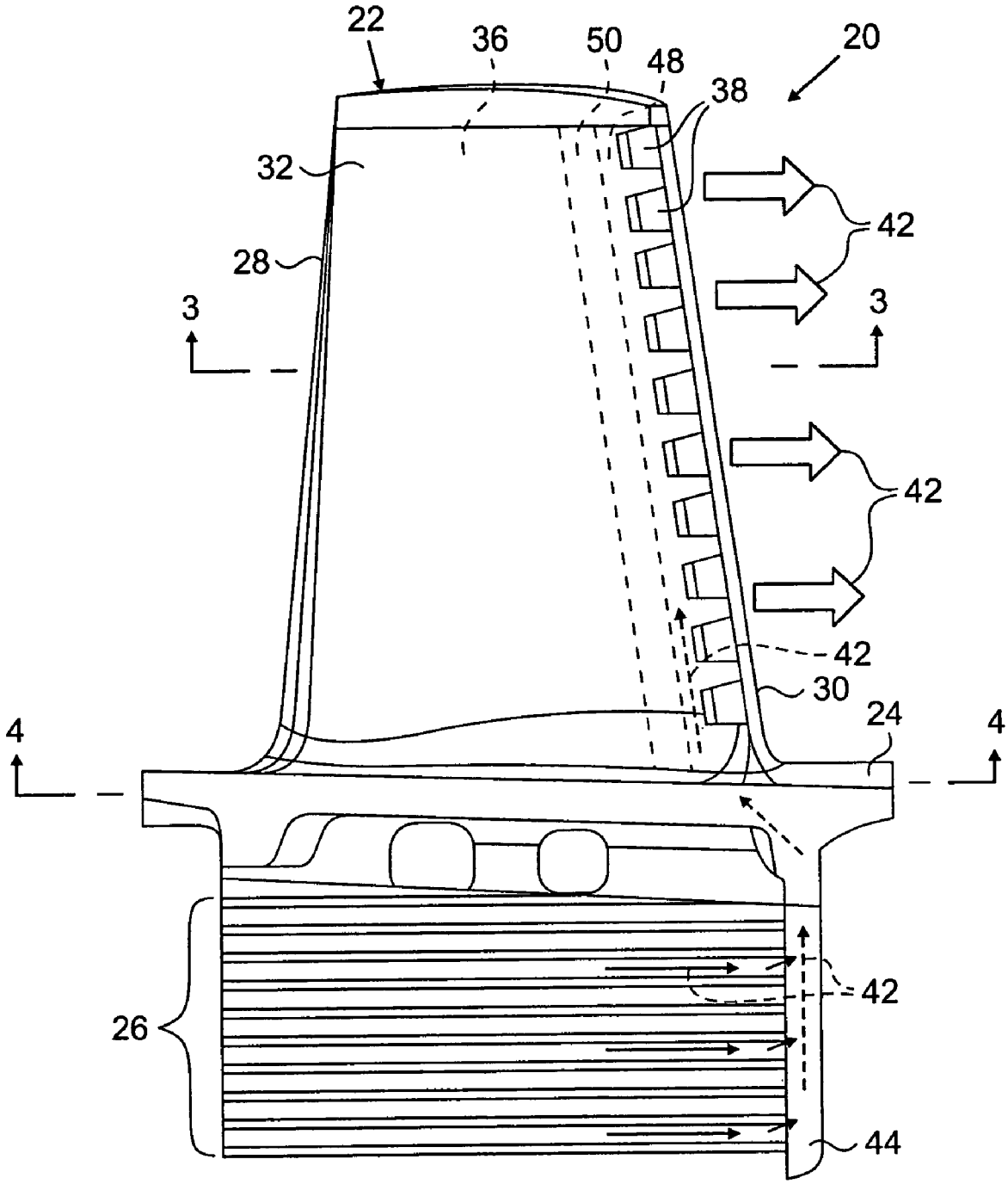
FIG. 2 is a side view of the turbine blade of FIG. 1.
Figure 3:
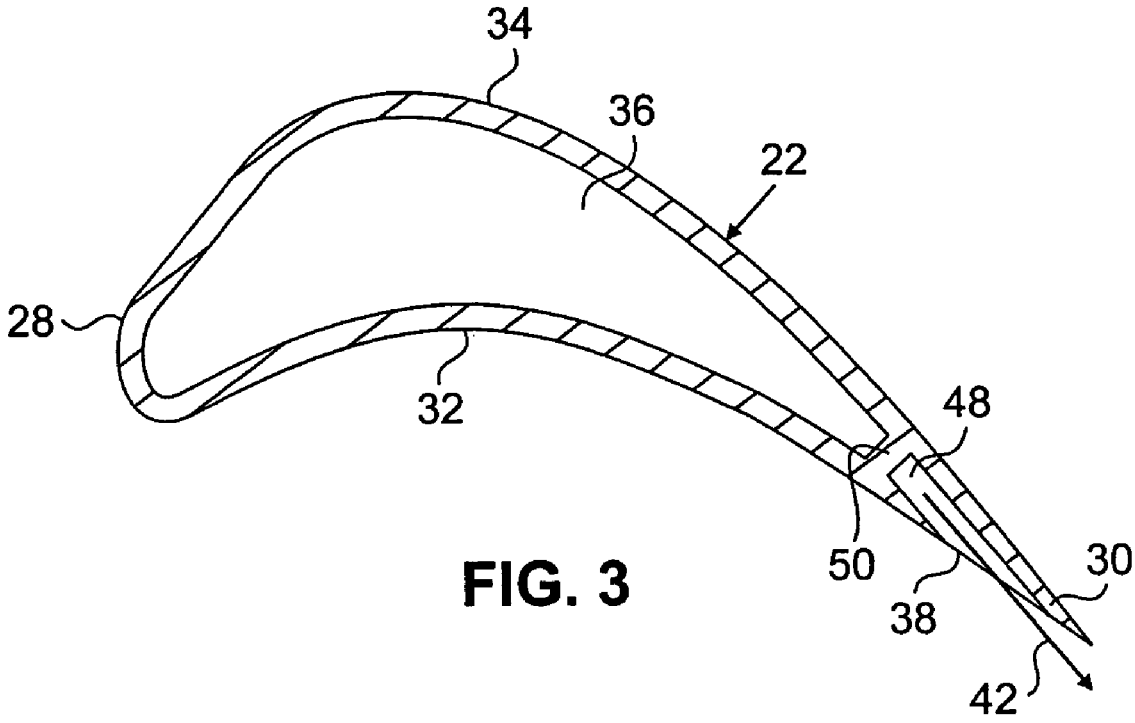
FIG. 3 is a cross-sectional view of the turbine blade, taken along line 3-3 of FIG. 2.
Figure 4:
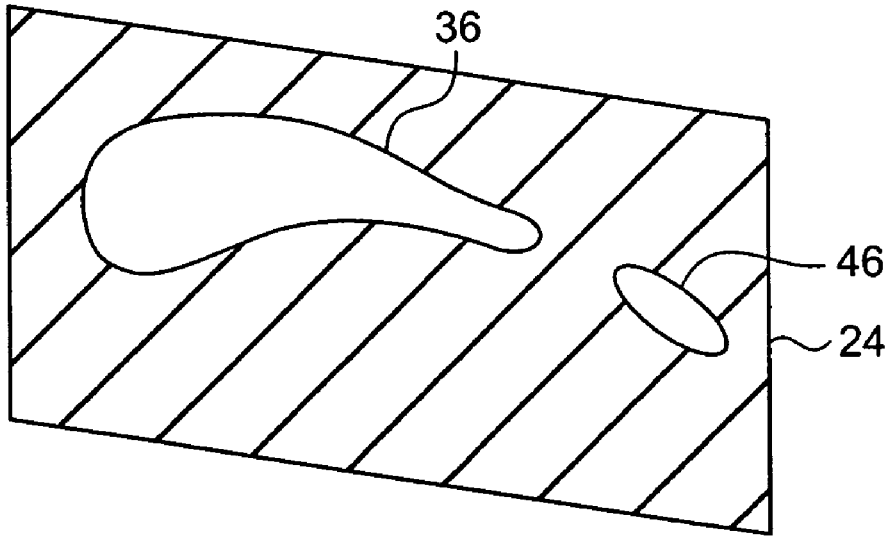
FIG. 4 is a cross-sectional view of the turbine blade, taken along line 4-4 of FIG. 2.

FIG. 2 is a side view of the turbine blade 20. FIG. 3 is a cross-sectional view of the turbine blade 20 taken along line 3-3 of FIG. 2, and FIG. 4 is a cross-sectional view of the turbine blade 20 taken along line 4-4 of FIG. 2. As shown in FIG. 2, an optional flow deflector 44 is located at an aft end of the blade root 26. The flow deflector 44 can have a scoop-like shape that extends beyond the inner end of the root 26 in manner similar to the flow deflector disclosed in U.S. Pat. No. 6,974,306 by Djeridan et al. The flow deflector 44 redirects at least a portion of the airflow 42, and typically redirects most of the airflow 42 from a generally axial direction to a generally radially outward direction. As shown in FIGS. 3 and 4, the redirected airflow 42 can then flow through an internal passageway 46 through the root portion 26 and the platform 24 to an airflow chamber 48 inside the airfoil 22. The openings 38 extend to the airflow chamber 48, such that airflow 42 can pass out of the airflow chamber 48 through the openings 38 to provide film cooling to the thin portion of the airfoil 22 at the trailing edge 30 in a conventional manner. The film cooling process is explained further below.

As shown in FIG. 3, the airflow chamber 48 is located at or near the trailing edge 30 of the airfoil 22, and the vaporization section 36 is located at or near the leading edge 28 of the airfoil 22. An internal wall 50 is defined by the airfoil 22 between the airflow chamber 48 and the vaporization chamber 36. In one embodiment, the wall 50 can be about 30 mil in an axial direction. The location and precise dimensions of the wall 50 will be determined as function of the heat load on the blade 20 in a particular application. Likewise, the relative sizes and configurations of the vaporization chamber 36 and the airflow chamber 48 will also be determined as function of heat loading.

The vaporization chamber 36 and the condenser 40 form a vapor cooling subsystem that provides cooling to a portion of the airfoil 22 at or near the leading edge 28. In the illustrated embodiment, the vaporization chamber 36 is shown in a simplified form. However, the vaporization chamber 36 can be configured in any suitable manner. A fluid is contained within the vapor cooling subsystem, and can pass between the vaporization chamber 36 and the condenser 40. In a liquid state, the fluid is distributed to the vaporization chamber 36, where the liquid fluid absorbs thermal energy and is converted to a gaseous state when its boiling point is reached. The gaseous fluid then passes to the condenser 40, which removes thermal energy to convert the fluid back to the liquid state. The liquid fluid can then be returned to the vaporization chamber 36 and the process continued.

Figure 5:
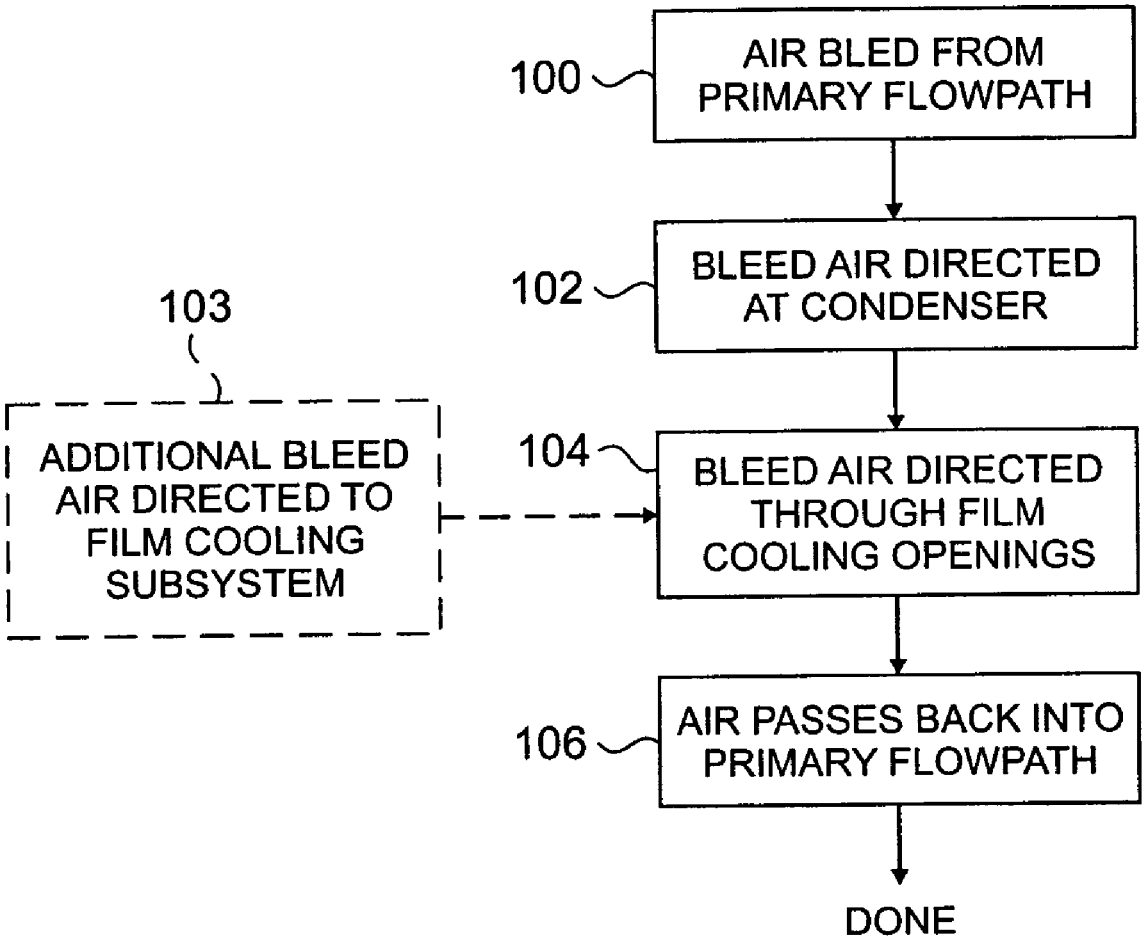
FIG. 5 is a flow chart detailing steps performed to cool the turbine blade.

In operation, the present invention provides cooling to the blade 20. FIG. 5 is a flow chart detailing steps performed to cool the turbine blade 20. While in use, the airfoil 22 is subjected to high temperature conditions as hot gases move through the primary flowpath of the engine in which the blade 20 is installed. The vaporization subsystem absorbs thermal energy with the fluid present in the vaporization chamber 36 and transfers that absorbed thermal energy to the condenser 40. At the same time, air is bled from the primary flowpath (step 100), for example compressor bleed air is taken from a suitable compressor stage. At least some of the bleed air is then routed to the location of the blade 20 and directed at the exterior surfaces of the condenser 40 in airflow 42 (step 102). Typically, the bleed air is directed into a disk slot in which the root portion 26 is retained, allowing the airflow 42 to pass through one or more gaps between the disk slot and the condenser 40 in the root portion 40. As the bleed air in the airflow 42 passes the condenser 40, the bleed air absorbs thermal energy from the fluid inside the condenser 40. At least some of the bleed air in the airflow 42 is then redirected by the flow deflector 44 and through the internal passageway 46. Some additional thermal energy can be absorbed by the bleed air while in the internal passageway 46. It is desired to redirect close to 100% of the bleed air into the passageway 46. Optionally, additional bleed air not used to cool the condenser 40 can be introduced to the passageway 46 to bolster film cooling (step 103). Next, the bleed air in the airflow 42 passes from the passageway 46 to the airflow chamber 48 and through the openings 38 at the trailing edge 30 of the airfoil 22 (step 104). As the bleed air leaves the openings 38, it passes over the exterior surface of the airfoil 22 to provide film cooling in a conventional manner. After leaving the openings 38, the bleed air is exhausted into the engine's primary airflow in a direction that is generally parallel with the primary airflow (step 106). In this way, the hybrid cooling system of the present invention utilizes vapor cooling to cool a large portion of the airfoil 22 of the blade 20 at or near its leading edge 28. Film cooling is then used to cool a portion of the airfoil 22 at or near the trailing edge 30, which is difficult to cool using vapor cooling alone.

By using the same bleed air to both cool the condenser 40 and to provide film cooling through the openings 38, it is possible to return almost all of the bleed air used for cooling the blade 20 to the primary flowpath. Furthermore, by exhausting bleed air generally parallel to the primary flowpath, mixing loss is reduced. These factors help promote engine power efficiency and fuel efficiency, and facilitate thrust-specific fuel consumption (TSFC). In addition, the hybrid cooling system of the present invention allows a high degree of cooling to be provided to the blade 20, which can help improve the lifespan of the blade 20.

Although the present invention has been described with reference to preferred embodiments, workers skilled in the art will recognize that changes may be made in form and detail without departing from the spirit and scope of the invention. For instance, the hybrid cooling system of the present invention can be applied to a variety of gas turbine engine components, including nearly any type of blade or vane having an airfoil.

What is claimed is:

1. An apparatus for a gas turbine engine, the apparatus comprising: an airfoil defining a leading edge and a trailing edge; a root located adjacent to the airfoil; a vapor cooling system having a vaporization section located within the airfoil and a condenser section located within the root; a film cooling system for cooling the airfoil in conjunction with the vapor cooling system; and a flow deflector extending from the root, and downstream from the condenser section, wherein the flow deflector directs fluid used to cool the condenser section of the vapor cooling system into the film cooling system.

2. The apparatus of claim 1, wherein the vaporization section within the airfoil is located at or near the leading edge of the airfoil.

3. The apparatus of claim 1, wherein the film cooling system is configured to provide a cooling film at or near the trailing edge of the airfoil.

4. The apparatus of claim 1 wherein the film cooling system comprises:

a plurality of openings located at or near the trailing edge of the airfoil; and a cooling fluid supply duct in fluid communication with an inlet defined at the root and each of the openings located at or near the trailing edge of the airfoil.

5. The apparatus of claim 4, wherein the openings are each slot-shaped.

6. The apparatus of claim 1 and further comprising:

a wall defined by a portion of the airfoil, wherein the wall separates the vapor cooling system and the film cooling system.

* * * * *